United States Patent [19]

Menth et al.

[11] 4,116,726

[45] Sep. 26, 1978

[54] AS-CAST PERMANENT MAGNET SM-CO-CU MATERIAL WITH IRON, PRODUCED BY ANNEALING AND RAPID QUENCHING

[75] Inventors: Anton Menth; Anthony J. Perry, both of Nussbaumen; Ulrich Spinner, Aeugst, all of Switzerland

[73] Assignee: BBC Brown, Boveri & Company Limited, Baden, Switzerland

[21] Appl. No.: 810,673

[22] Filed: Jun. 27, 1977

Related U.S. Application Data

[62] Division of Ser. No. 637,057, Dec. 2, 1975.

[30] Foreign Application Priority Data

Dec. 18, 1974 [CH] Switzerland ..... 16878/74

[51] Int. Cl.[2] ..... H01F 1/08; H01F 1/22; H01F 7/02

[52] U.S. Cl. ..... 148/31.57; 148/101

[58] Field of Search ..... 148/31.57, 101, 102, 148/103; 75/152

[56] References Cited

U.S. PATENT DOCUMENTS

| | | | |
|---|---|---|---|
| 3,424,578 | 1/1969 | Strnat et al. | 148/103 |
| 3,560,200 | 2/1971 | Nesbitt et al. | 148/101 |
| 3,844,850 | 10/1974 | Benz | 148/103 |
| 3,947,295 | 3/1976 | Tawara et al. | 148/31.57 |

*Primary Examiner*—R. Dean
*Assistant Examiner*—Michael L. Lewis
*Attorney, Agent, or Firm*—Oblon, Fisher, Spivak, McClelland & Maier

[57] ABSTRACT

A permanent-magnet material containing samarium, cobalt, copper and iron, has the composition $Sm(Co_{1-x-y}Fe_xCu_y)_z$, wherein $0 < x < 0.2$, $0.1 < y < 0.3$ and $6.5 < z < 7.5$.

3 Claims, 11 Drawing Figures

AS-CAST PERMANENT MAGNET SM-CO-CU MATERIAL WITH IRON, PRODUCED BY ANNEALING AND RAPID QUENCHING

This is a division of application Ser. No. 637,057, filed Dec. 2, 1975.

BACKGROUND OF THE INVENTION

1. Field of the Invention

This invention is concerned with permanent-magnet material of samarium, cobalt, copper and iron, a method of producing such material and an application for it.

2. Description of the Prior Art

Material of the aforementioned type has been described for example by H. Senno and Y. Tawara in IEEE Transactions on Magnetics, Vol. 10, No. 2, June 1974, p. 313 ff., and is also known from DT-OS 2,406,782. According to these references Sm Ce Co Fe Cu- alloys especially those within the 1-5 to 2-17 composition range are distinguished by a high coercive force $_iH_c$ and good remanence $B_r$ with an improved energy product $(BH)_{max}$ as compared to exclusively copper-hardened SmCo-magnetic material. These good characteristics are obtained by the addition of cerium and iron to the Sm Co Cu- alloys, but are dependent to a great extent, however, on the amount of cerium added and on the proportion of it with respect to the cobalt, copper and iron. As a result, these alloys are not entirely satisfactory.

SUMMARY OF THE INVENTION

Accordingly, it is an object of this invention to produce a new permanent-magnet material containing samarium, cobalt and copper, which offers outstanding magnetic properties even without the addition of cerium and which can, at the same time, be made in a simple and economical way, this process effecting a further significant improvement in the magnetic properties of the new material.

Briefly, this and other objects of this invention as will hereinafter become clear from the ensuing discussion have been attained by providing a permanent-magnet material having the composition $Sm\ (Co_{1-x-y}\ Fe_XCu_Y)_Z$, wherein $0<x<0.2$, $0.1<Y<0.3$ and $6.5<Z<7.5$.

If suitable methods are used in producing this permanent-magnet material, the materials of the invention not only exhibit magnetic properties at least as good as those of known materials, but it is also necessary to add only a single alloy component, namely iron, to a copper-hardened starting alloy if such improvement treatment is called for. Such a suitable process is characterized by the fact that the alloy comprising the molten-together elements is first heat-treated by raising it to a temperature between 1150° to 1250° C. By this means a coarse-grained material is produced with a matrix consisting in general of millimeter-size, statistically oriented, single-crystal grains. Each grain here represents an almost perfectly aligned permanent magnet. By subsequent rapid quenching, e.g., in argon or liquid nitrogen, the properties of the heat-treated permanent-magnet material can be improved still further.

It is preferred, however, to subject the material to a second heat treatment by heating it to a temperature between 750° and 850° C. Very considerable improvements in the magnetic properties are thereby obtained, particularly after a one hour tempering at about 820° C.

These process steps effect an improvement in the magnetic properties not only of the aforementioned SmCoCuFe-material but even in the iron-free SmCoCu-material.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawings, wherein:

FIG. 4 shows photomicrographs of polished sections of the permanent-magnet materials of FIG. 2. magnified 100 times.

DETAILED DESCRIPTION OF THE PREFERRED EMBODIMENTS

Figure 1A:
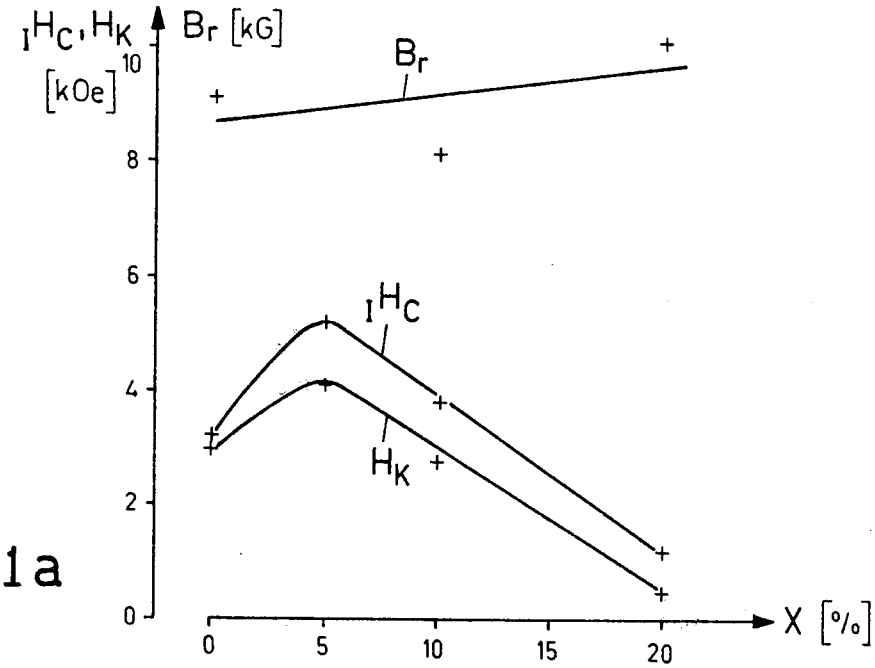
FIG. 1 shows the magnetic parameters, knee field strength $H_k$ coercive field strength $_iH_c$ and remanence $B_r$, of permanent-magnet materials of composition $Sm(Co_{0.84-x}Fe_xCu_{0.16})_{6.85}$ as functions of the proportion $x$ of iron FIG. 1*a* for "like cast", spherical single-crystal permanent-magnets after 1-hour heat treatment at 1250° C and subsequent rapid quenching in argon, and FIG. 1*b* for "like cast", spherical single-crystal permanent magnets after 1-hour heat treatment, subsequent rapid quenching in argon and further 1-hour heat treatment at 790° C.

Having generally described the invention, a more complete understanding can be obtained by reference to certain specific examples, which are included for purposes of illustration only and are not intended to be limiting unless otherwise specified.

EXAMPLE 1

The following iron-containing alloys were produced:

1. $Sm(Co_{0.80}Fe_{0.04}Cu_{0.16})_{6.85}$
2. $Sm(Co_{0.76}Fe_{0.08}Cu_{0.16})_{6.85}$
3. $Sm(Co_{0.67}Fe_{0.17}Cu_{0.16})_{6.85}$
4. $Sm(Co_{0.82}Fe_{0.04}Cu_{0.14})_{7}$
5. $Sm(Co_{0.78}Fe_{0.08}Cu_{0.14})_{7}$
6. $Sm(Co_{0.05}Fe_{0.04}Cu_{0.11})_{7.25}$
7. $Sm(Co_{0.80}Fe_{0.09}Cu_{0.11})_{7.25}$

All material samples were made by melting together in an induction oven the elements samarium, cobalt, copper and iron. 99.9% pure samarium, 99.99% pure cobalt, oxygen-poor 99.999% pure electrolytic copper and over 99.9% pure Armco-iron were used as starting materials. The coarsely ground metals were placed in a boron nitride crucible and melted at about 1400° C in a high-purity argon atmosphere. The melt was allowed to solidify while slowly cooling and the solidified material was further quenched.

In the first step of the process the alloy samples were annealed for about 1 hour at temperatures between 1150° and 1250° C, preferably at about 1200° C, and then rapidly quenched. This rapid quenching was performed in argon or liquid nitrogen for example. The permanent-magnet material formed in this way exhibited a matrix consisting of grains of up to 5 mm in size, in which each grain constituted an almost perfectly aligned permanent magnet. Here, the crystallographic and, therefore, also the magnetic preferred directions are statistically distributed over the material.

In the second step of the process the materials were subjected to yet another heat treatment in either high-purity argon or in vacuum. For this, the alloy samples were heated for a period of about 1 hour at temperatures between 750° and 850° C, preferably at 820° C.

From the coarse-grained SmCoCuFe -alloys spherical single-crystal specimens of about 2 mm diameter were formed by grinding in a mill. They were fully magnetized by pulsing in a uniform magnetic field of up to 60 KOe in strength. By means of a magnetometer, the demagnetization curues of the spherical samples were measured in a field of 23 KOe maximum. From these, magnetic parameters such as the coercive field strength $_IH_c$, knee field strength $H_k$ and remanence $B_r$ were obtained.

The parameters of the alloys 1–7 are summarized in Table 1 below. From this it is seen that almost all the alloys have values of coercive field strength $_IH_c$ and remanence $B_r$ that are just as good as or better than those of known alloys of samarium, cobalt, copper and iron, e.g. the alloys of Dt-OS, 2,406,782. From this table it is also apparent, however, that all the alloys with the composition $Sm(Co_{1-x-y}Fe_xCu_y)_z$ in a range defined by the approximate limits $0<x<0.2$; $0.1<y<0.3$ and $6.5<z<7.5$ have outstanding magnetic properties.

Table 1

Magnetic Parameters of the SmCoFeCu-alloys 1–7.

| ALLOY | $_IH_c$ (kOe) | $H_K$ (kOe) | $B_r$ (kG) |
|---|---|---|---|
| $Sm(Co_{0.84-x}Fe_xCu_{0.16})_{6.85}$ | 5.2 | 4.2 | 9.8 |
| $Sm(Co_{0.80}Fe_{0.04}Cu_{0.16})_{6.85}$ | 4.8 | 3.0 | 8.1 |
| $Sm(Co_{0.76}Fe_{0.08}Cu_{0.16})_{6.85}$ | 1.2 | 0.5 | 10.1 |
| $Sm(Co_{0.67}Fe_{0.17}Cu_{0.16})_{6.85}$ | | | |
| $Sm(Co_{0.86-x}Fe_xCu_{0.14})_{7}$ | 4.4 | 2.0 | 8.4 |
| $Sm(Co_{0.82}Fe_{0.04}Cu_{0.14})_{7}$ | | | |

Table 1-continued

Magnetic Parameters of the SmCoFeCu-alloys 1–7.

| ALLOY | $_IH_c$ (kOe) | $H_K$ (kOe) | $B_r$ (kG) |
|---|---|---|---|
| $Sm(Co_{0.78}Fe_{0.08}Cu_{0.14})_{7}$ | 4.0 | 3.0 | 10.8 |
| $Sm(Co_{0.89-x}Fe_xCu_{0.11})_{7.25}$ | | | |
| $Sm(Co_{0.85}Fe_{0.04}Cu_{0.11})_{7.25}$ | 1.8 | 0.4 | 11.2 |
| $Sm(Co_{0.80}Fe_{0.09}Cu_{0.11})_{7.25}$ | 1.6 | 0.6 | 10.8 |

Figure 1B:
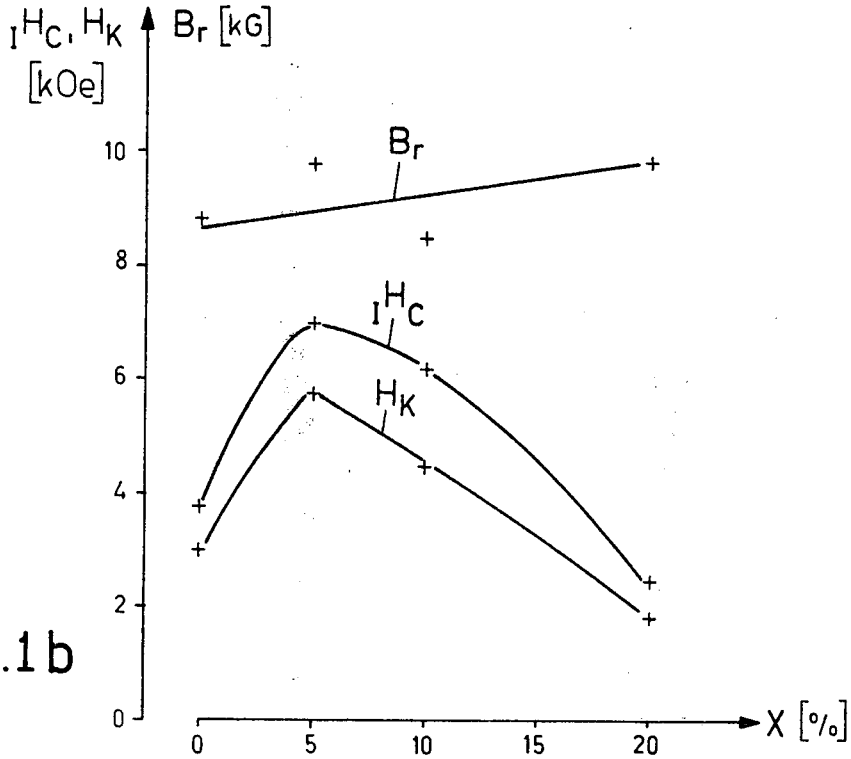

The result of measurements on the alloys 1–3 of Table 1 are presented graphically in FIG. 1*b*. Corresponding measured values for these alloys after partial heat treatment are given in FIG. 1*a*. It is seen from these curves that in the completely heat-treated as well as in the partially heat-treated alloys with an iron proportion $x$ of 0.05, the coercive field strength $_IH_c$ and the knee field strength $H_k$ reach optimum values. However, the coercive and knee field strengths are improved much more still by the second process step leading to complete heat treatment.

With an iron and cobalt content between 73 and 75 atom percent, the knee field strength $H_k$, measured in (KOe), reaches about half the value of the remanence $B_r$, measured in (KG). Magnet material of this type is distinguished by an especially high energy product, while that with increasing iron and cobalt content exhibits an increasing remanence but at the same time shows considerably diminished coercive and knee field strengths. On the other hand of course, material with decreasing iron and cobalt content exhibits increased coercive and knee field strengths, but is characterized by a drop in remanence.

EXAMPLE 2

The following iron-free alloys were produced:

8. $Sm(Co_{0.84}Cu_{0.16})_{6.85}$
9. $Sm(Co_{0.86}Cu_{0.14})_{7}$
10. $Sm(Co_{0.89}Cu_{0.11})_{7.25}$

Like the iron-containing alloys of Example 2, all these alloys were made by melting the elements samarium, cobalt and copper together, heat treating them and measuring them magnetometrically.

In table 2 are collected the magnetic parameters of these alloys. From this table it is seen that almost all the alloys exhibit values of coercive field strength and remanence exceeding those of stoichiometrically similar, but differently produced alloys-e.g. the alloys of Dt-05 1,915,358.

Table 2

Magnetic Parameters of the SmCoCu-Alloys 8–10.

| ALLOY | $_IH_c$ (kOe) | $H_K$ (kOe) | $B_r$ (kG) |
|---|---|---|---|
| $Sm(Co_{0.84}Cu_{0.16})_{6.85}$ | 5.4 | 4.6 | 9.1 |
| $Sm(Co_{0.86}Cu_{0.14})_{7}$ | 4.0 | 2.8 | 9.5 |
| $Sm(Co_{0.89}Cu_{0.11})_{7.25}$ | 1.4 | 0.2 | 11.0 |

From Tables 1 and 2 it is seen that with suitable heat treatment, iron-containing SmCoCu-alloys attain knee field strengths $H_k$ of over 4KOe, while iron-free ones attain values only up to 3KOe. The significance of such high values of knee field strength will be explained below with the help of FIG. 2.

Figure 2:
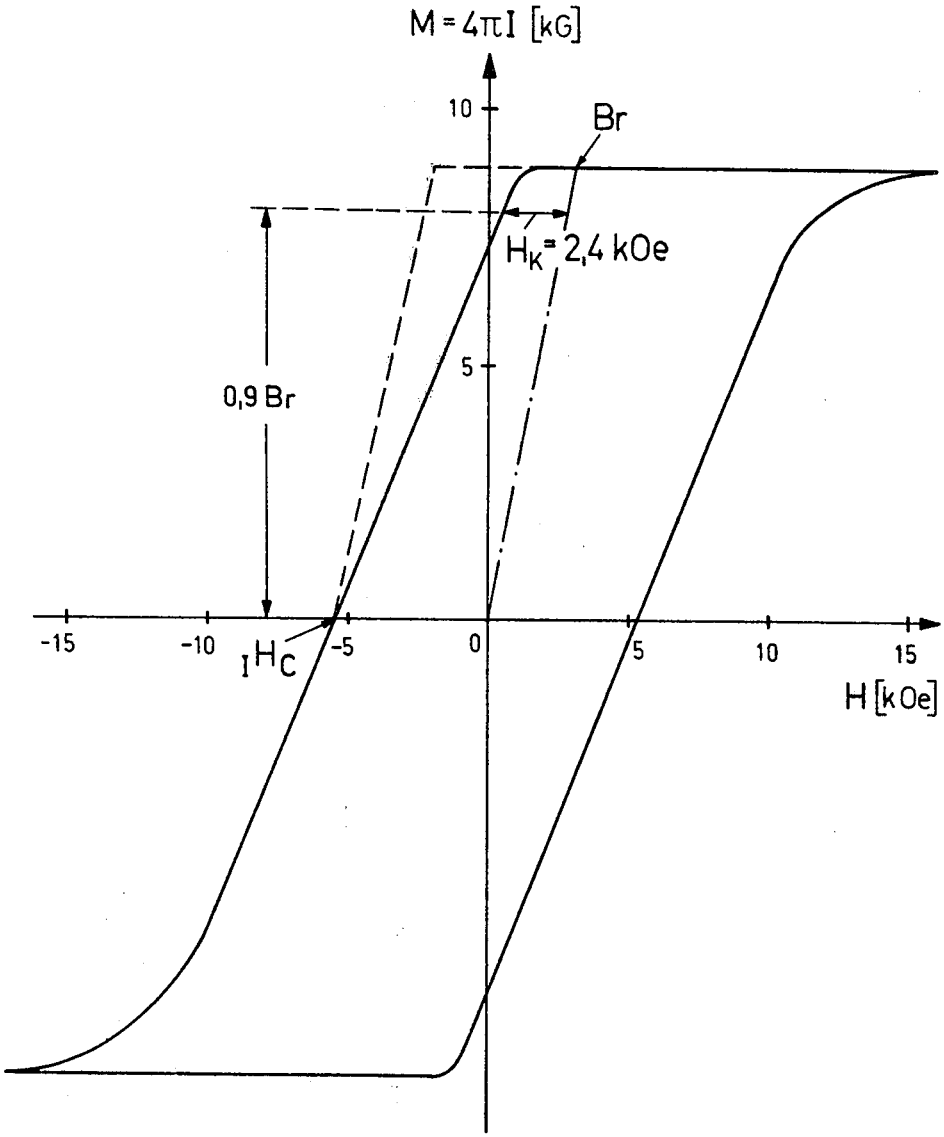
FIG. 2 shows the hysteresis loop of a spherical single-crystal permanent magnet of an alloy with the composition $Sm(Co_{0.84}Cu_{0.16})_{6.85}$ which was not heated ("like cast" state of the alloy)

In the hysteresis curve shown in FIG. 2 is plotted the magnetization, $M=4\pi I$ (KG), of a spherical single-crystal sample of composition $Sm(Co_{0.084}Cu_{0.16})_{6.85}$ versus the field strength H (KOe). An idealized demagnetization curve is shown by the dashed line. Such a curve is given by the specified values of the coercive field strength $_IH_c$ and the remanence $B_r$, by the maximum slope $\Delta M/\Delta H = 3$ of the demagnetization curve of a spherical permanent magnet in the region of vanishing magnetization M, as well as by the course of such a curve parallel to the H-axis in the region of maximum magnetization M. If the knee field strength $H_k$ is defined as the field strength given by the distance between the demagnetization curve through the origin and the unshifted demagnetization curve in the region of its knee along a line 0.9 $B_r$(G) from the H-axis and parallel to it, then it is seen from FIG. 2 that the knee field strength $H_k$ for the idealized curves is equal to the coercive field strength $_IH_c$, but in the case of the SmCoCu-alloy it is equal to only a fraction of the coercive field strength $_IH_c$ on account of too slow a rise of the demagnetization curve. Because of the low knee field strength $H_k$, the energy product $(BH)_{max}$ of this permanent-magnet material is not very large.

However, it has now been recognized that the hysteresis curve shown in FIG. 2 is determined by a two-phase structure of the SmCoCu-alloy. The low knee field strength, and therefore also the low energy product of this alloy, are a consequence of a relatively soft-magnetic 2–17 phase, probably a $Sm_2(Co_{1-x}Cu_x)_{17}$ - phase with $x \sim 0.1$ embedded in a hard-magnetic $Sm(Co_{1-x}Cu_y)_x$ - phase with $5 \leqq x \leqq 6$ and $0.1 < 7\,y 0.3$. By the addition of iron to the initial SmCoCu-alloy and suitable heat treatment of this SmCoCuFe-alloy, but also just by suitable heat treatment of the initial SmCoCu alloy, the inventors have succeeded in raising the knee field strength $H_k$, and thus the energy product, by a large amount without changing the coercive field strength $_IH_c$, but still with an accompanying increase in the remanence. Thus, the knee field strength of the alloy $Sm(Co_{0.84}Cu_{0.16})_{6.85}$, which according to FIG. 1 was only 2.4 KOe in the "like cast" state, was able to be increased by heat treating in accordance with this invention to 4.6 KOe according to Table 2 and with it, the energy product was raised far above 20 MGOe.

Figure 3A:
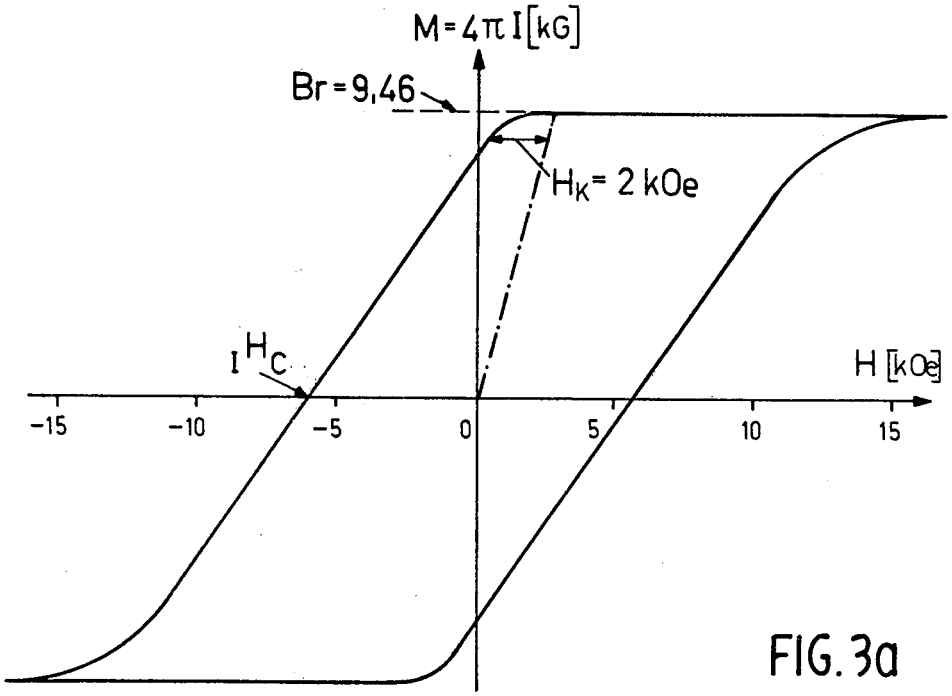
FIG. 3 shows the hysteresis loop of a spherical single-crystal permanent magnet of an alloy with the composition $Sm(Co_{0.80}Fe_{0.04}Cu_{0.16})_{6.85}$ FIG. 3*a* in the "like cast" state without heat treatment, and FIG. 3*b* in the "like cast" state after a 1-hour heat treatment at 1230° C, subsequent quenching in argon and a further heat-treatment at 850° C.
Figure 3B:
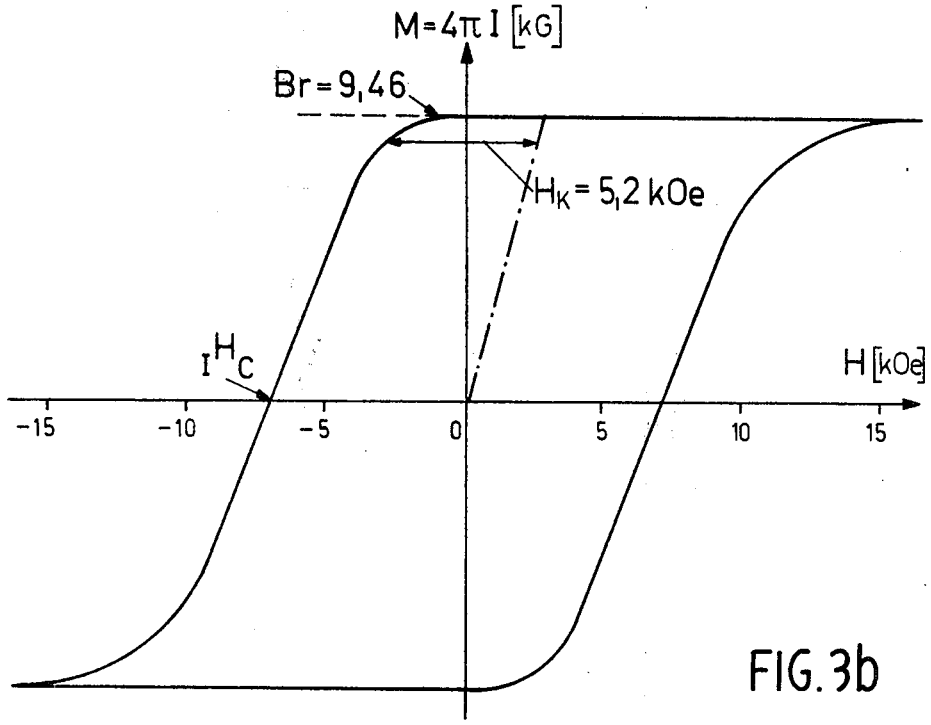

The influence of the heat treatment on an iron-containing SmCoCu-alloy can be seen from the hysteresis curves of FIG. 3. Here the knee field strength $H_k$ of the alloy after heat treatment has grown from 2.0 KOe in the "like cast" state to 0.8 of the coercive field strength ($H_k = 5.2 \approx 0.8\ X_IH_c$ (KOe), where $_IH_c = 6.8$ KOe). Because of this increased knee field strength the energy product of this alloy is about 25 MGOe.

Figure 4A:
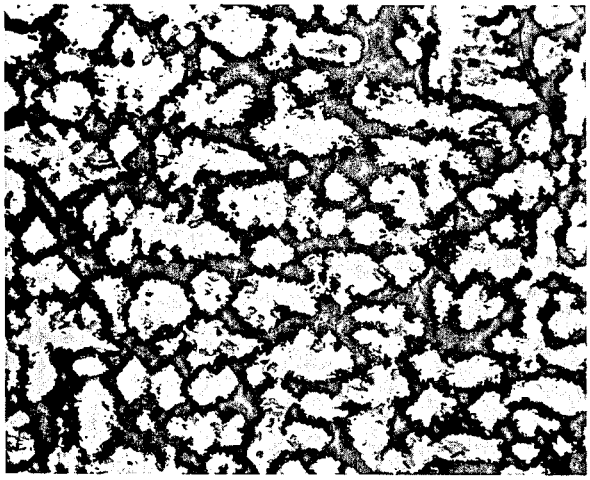
FIG. 4*a* in the "like cast" state without heat treatment.

The existence of two-phase structure and its alteration by the heat treatment of this invention can be seen in the photomicrographs of polished sections *a* and *b* of FIG. 4. In *a* is the 100 x magnified polished section of a $Sm(Co_{0.80}Fe_{0.04}Cu_{0.16})_{6,85}$ - alloy in which the bright areas are a relatively soft-magnetic 2–17-phase and the dash a hard-magnetic 1–5-phase. It is evident that the not-yet-heat-treated alloy already exhibits a distinct separation of components in the "like cast" state. This is recognizable from the sharp boundaries between the bright and dark regions.

In contrast thereto, iron-free alloys in the "like cast" state show a considerably more thorough mixing of the two phases.

Figure 4B:
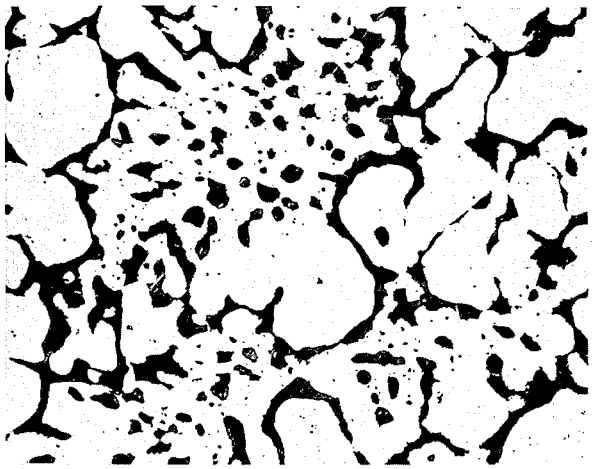
FIG. 4*b* in the "like cast" state after treatment as in FIG. 2*b;*

After carrying out the heat treatment according to this invention, the phases are even more thoroughly mixed (apparent from the uniformity of the phase structure and the sharp phase boundaries of the alloy sample of FIG. 4*b*). The same separation effect occurs in carrying out the same heat treatment of SmCoCu-alloys.

Figure 5A:
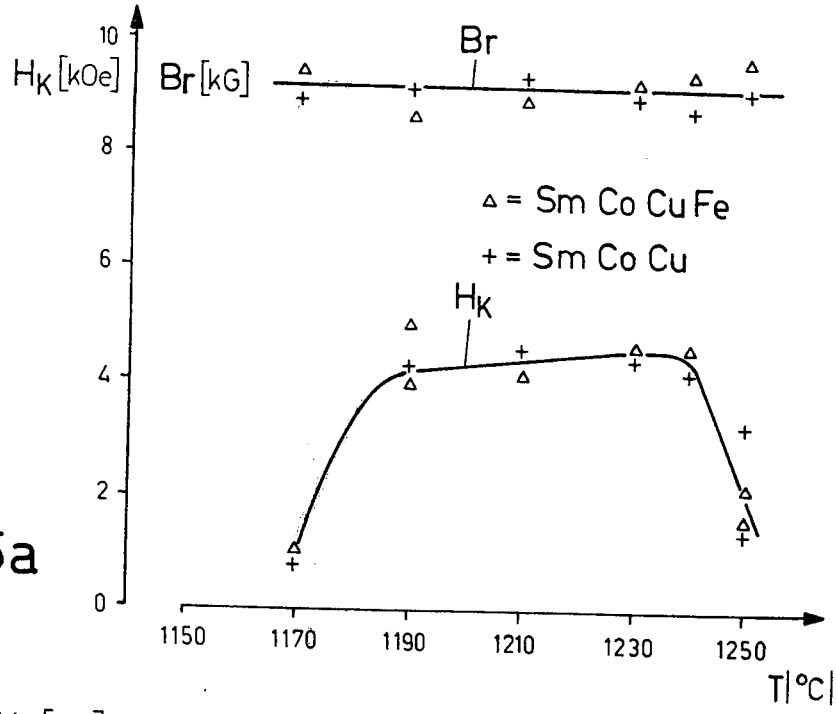
FIG. 5*a* knee field strength $H_k$ and remanence $B_r$, and FIG. 5*b* coercive field strength $_iH_c$, of permanent-magnet material with the composition $Sm(Co_{0.84}Cu_{0.16})_{6.85}$ (points plotted as X's) and $Sm(Co_{0.80}Fe_{0.04}Cu_{0.16})_{6.85}$ (points plotted as Δ's) after a 1-hour heat treatment at different annealing temperatures T(° C), subsequent rapid quenching and a further 1-hour heat treatment at 790° C.
Figure 5B:
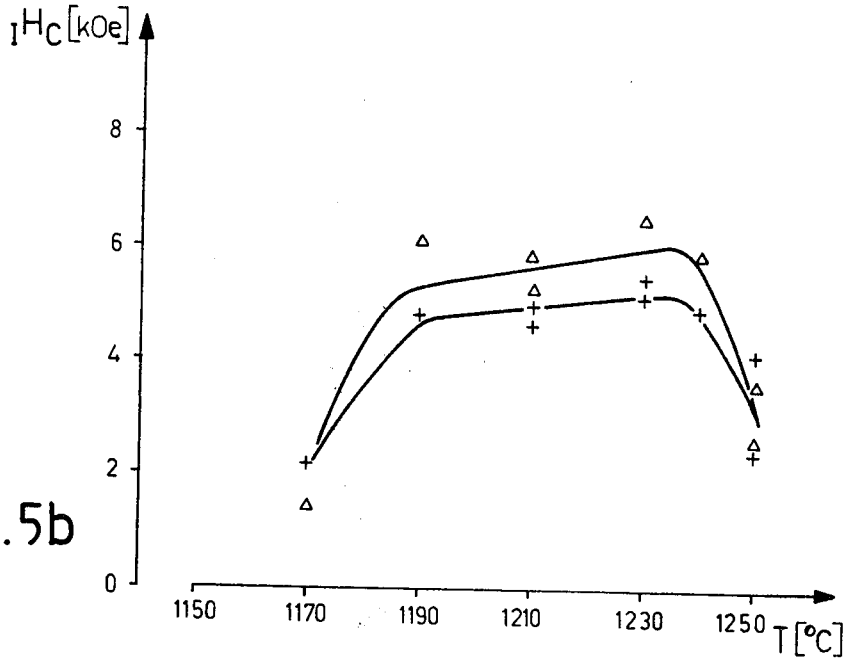
FIG. 5 shows the magnetic parameters.
Figure 6A:
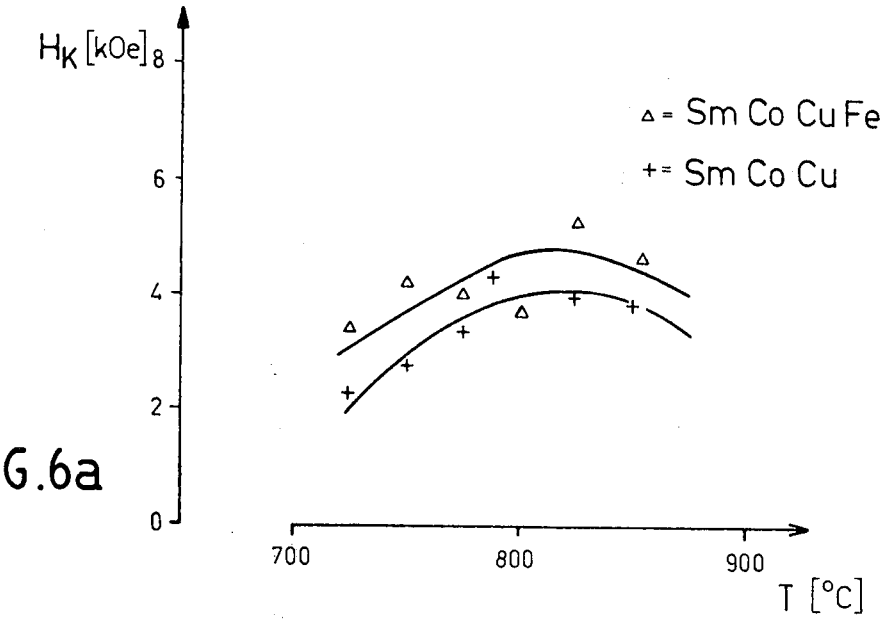
FIG. 6 shows the magnetic parameters, FIG. 6*a* knee field strength $H_k$ and FIG. 6*b* coercive field strength $_iH_c$, of permanent-magnet material with the composition $Sm(Co_{0.84}Cu_{0.16})_{6.85}$ (points plotted as X's) and $Sm(Co_{0.08}Fe_{0.04}Cu_{0.16})_{6.85}$ (points plotted as Δ's) after 1-hour heat treatment at 1230° C, subsequent rapid quenching and a further 1-hour heat treatment at temperatures T (° C).
Figure 6B:
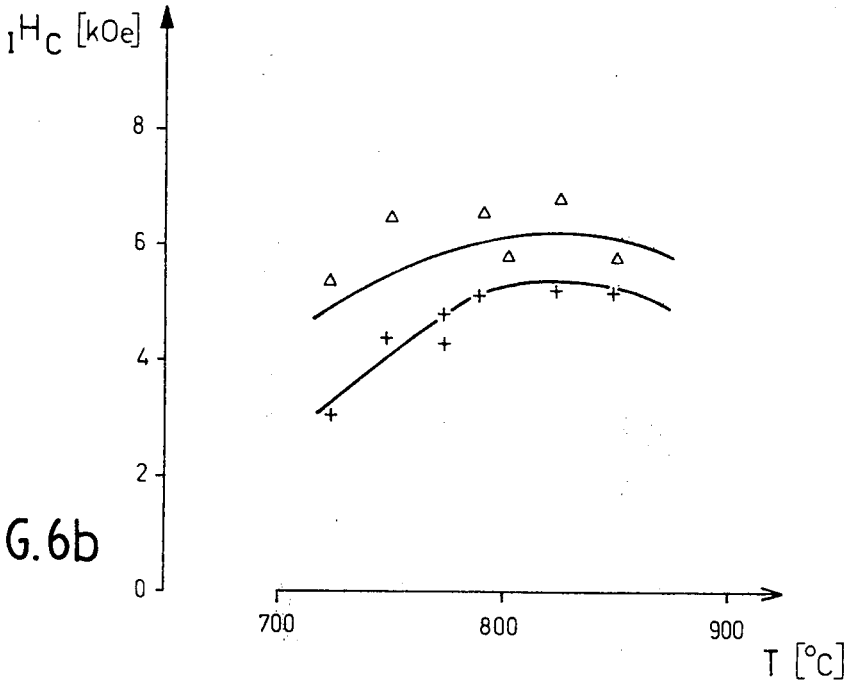

From the curves of FIG. 5, it can be seen how by suitable choice of annealing temperature the knee and coercive field strengths of both iron-containing and iron-free SmCoCu-alloys can be optimized. The temperature range between 1190° and 1250° C proves to be especially suitable with a 1-hour annealing. Thus for a $Sm(Co_{0.80}Fe_{0.04}Cu_{0.16})_{6.85}$-sample, after being annealed for 1 hour at 1230° C, then quenched and further heat treated for an hour at 790° C, the knee field strength $H_k$ increased from 1.8 KOe to 4.6 KOe and the energy product from 12 MGOe to almost 20 MGOe. Similarly it can be seen from FIG. 6 that by suitable choice of the temperature in the second heat treatment, the knee and coercive field strengths of both iron-containing and iron-free SmCoCu-alloys can be optimized. The temperature range between 750° and 850° C proves to be particularly suitable for a 1-hour heat treatment. For an annealed $Sm(Co_{0.80}Fe_{0.04}Cu_{0.16})_{6.85}$-sample after a 1-hour heat treatment at 825° C the knee field strength was raised to 5.8 KOe and with it the energy product far above 25 MGOe.

There are two ways to make arbitrarily large magnet bodies from the coarse-grained permanent-magnet material obtained from the melt. By normal freezing, either large single crystals can be pulled or by grinding the coarse-grained material to powder, sufficiently large magnet bodies can be produced by alignment, compaction and sintering of the power. In the powder-metallurgy method of making the magnet body it proves to be especially advantageous that the particle size of the powder obtained from the grinding process is not critical, since the magnetic properties of the materials of this invention are obtained by means of precipitation hardening and cannot be altered further by domain formation and and domain-wall movements.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A permanent-magnet material characterized by a matrix comprising statistically oriented, single crystal grains wherein each grain is an aligned permanent magnet and having the composition $Sm(Co_{1-x-y}Fe_xCu_y)_z$, wherein $0 < x < 0.2$, $0.1 < y < 0.3$ and $6.5 < z < 7.5$, prepared by a process comprising melting together said elements in amounts according to said composition, solidifying the melt by slowly cooling said melt, annealing the alloy of the melted-together elements at temperatures between 1150° and 1250° C, subsequently rapidly quenching said alloy, and further annealing said alloy at temperatures between 750° and 850° C.

2. The permanent-magnet material of claim 1, wherein said composition has the approximate formula $Sm(Co_{1-x-y}Fe_x\ Cu_y)_{6.85}$, wherein $0<x<0.2$ and $0.1<y<0.2$.

3. A permanent magnet comprising said permanent-magnet material of claim 1.

* * * * *